US009095484B1

(12) United States Patent
Bethea

(10) Patent No.: US 9,095,484 B1
(45) Date of Patent: Aug. 4, 2015

(54) WHEELCHAIR LEG GUARD

(71) Applicant: Lorraine E. Bethea, Chesapeake, VA (US)

(72) Inventor: Lorraine E. Bethea, Chesapeake, VA (US)

( * ) Notice: Subject to any disclaimer, the term of this patent is extended or adjusted under 35 U.S.C. 154(b) by 0 days.

(21) Appl. No.: 14/082,243

(22) Filed: Nov. 18, 2013

(51) Int. Cl.
*A61G 5/12* (2006.01)

(52) U.S. Cl.
CPC ..... *A61G 5/12* (2013.01)

(58) Field of Classification Search
CPC ..... A61G 5/12
USPC ..... 150/154; 280/304.1; 224/407; 297/440.1, 440.11, 440.23
See application file for complete search history.

(56) References Cited

U.S. PATENT DOCUMENTS

| | | | | |
|---|---|---|---|---|
| 3,289,219 | A | 12/1966 | Ferneau et al. | |
| 3,848,922 | A | 11/1974 | Blanford | |
| 4,243,265 | A | 1/1981 | Hanik | |
| 4,795,214 | A | 1/1989 | Holdt | |
| 4,924,814 | A | 5/1990 | Beaudet | |
| 5,333,887 | A | 8/1994 | Luther | |
| 5,437,496 | A | 8/1995 | Rickard | |
| 5,626,397 | A * | 5/1997 | Reid | 297/467 |
| D471,751 | S | 3/2003 | Chihlas | |
| 7,581,259 | B2 * | 9/2009 | Thompson | 2/69.5 |
| 7,581,265 | B1 | 9/2009 | Bourgraf et al. | |
| 7,971,297 | B2 | 7/2011 | Masson | |
| 7,997,597 | B2 | 8/2011 | Mehl | |
| 8,162,346 | B2 | 4/2012 | Purdue | |
| 2009/0179399 | A1 | 7/2009 | Mehl | |
| 2010/0201169 | A1 | 8/2010 | Fox et al. | |
| 2012/0144582 | A1 | 6/2012 | Gugliotti et al. | |

* cited by examiner

*Primary Examiner* — Joseph Rocca
*Assistant Examiner* — Felicia L Brittman
(74) *Attorney, Agent, or Firm* — Shaddock Law Group, PC

(57) ABSTRACT

A wheelchair leg guard that has a leg rest portion, a foot rest portion that extends from the leg rest portion, and a foot rest strap that extends from a first end to a second end. The first end of the foot rest strap is attached or coupled to the foot rest portion proximate a first end of the foot rest portion and the second end the foot rest strap is attached or coupled to the foot rest portion proximate a second end of the foot rest portion. A portion of the foot rest strap is releasably secured to a portion of the foot rest portion via interaction of a securing element attached or coupled to the foot rest portion and the foot rest strap. Side guards extend between and are attached or coupled to both the foot rest portion and the leg rest portion.

20 Claims, 6 Drawing Sheets

WHEELCHAIR LEG GUARD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of medical devices. More specifically, the present invention relates to a wheelchair accessory.

2. Description of Related Art

Typically, when seated in a wheelchair, a rider's feet rest on foot rests that are positioned at the end of foot rest brackets that extend from the wheelchair frame.

Unfortunately, the foot rests are typically rather narrow and it can be difficult for a rider to keep his or her feet firmly planted on the foot rests. This is especially true for patients having difficulty controlling their lower extremities.

If a riders feet slip from the foot rests, the rider's feet and legs can be caught under the wheelchair. In some instances, the entanglement can be so severe that the wheelchair rolls over on the rider. In either case, the rider can be injured if his or her feet and legs are caught under the wheelchair.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the wheelchair leg guard of the present invention can be fitted over the leg and foot rests of a standard wheelchair. The wheelchair leg guard supports and cushions the legs and feet of someone riding in the wheelchair, and, more importantly, bridges the gap between the leg extensions or foot rest brackets of the wheelchair so that the rider's feet and legs cannot slip from the foot rest brackets and be caught under the wheelchair. In certain exemplary embodiments, the wheelchair leg guard is substantially "L" shaped and may include bridge pieces spanning at least a portion of the apex of the "L".

In certain exemplary, nonlimiting embodiments, the wheelchair leg guard includes a leg rest portion, a foot rest portion, a foot rest strap, and side guards. In certain exemplary embodiments, the leg rest portion and foot rest portion may comprise flexible or rigid material.

In certain alternative, nonlimiting embodiments, the leg rest portion may comprise a front panel portion and a back panel portion. A leg rest cavity is defined between the front panel portion and the back panel portion and a leg rest stabilizer is disposed within the leg rest cavity.

The foot rest portion extends from the leg rest portion and comprises a top panel portion and a bottom panel portion. A foot rest cavity is defined between the top panel portion and the bottom panel portion and a foot rest stabilizer is disposed within the foot rest cavity.

The foot rest strap extends from a first end to a second end and the first end is attached or coupled to the foot rest portion proximate a first end of the foot rest portion. The second end of the foot rest strap is attached or coupled to the foot rest portion proximate a second end of the foot rest portion. A portion of the foot rest strap is releasably secured to a portion of the foot rest portion via interaction of a securing element attached or coupled to the foot rest portion and a corresponding securing element attached or coupled to the foot rest strap.

The side guards extend between and are attached or coupled to both the foot rest portion and the leg rest portion.

In certain exemplary embodiments, the wheelchair leg guard further includes a leg rest strap that extends from a first end to a second end. The first end is attached or coupled to the leg rest portion proximate a first end of the leg rest portion and the second end is attached or coupled to the leg rest portion proximate a second end of the leg rest portion. A portion of the leg rest strap is releasably secured to a portion of the leg rest portion via interaction of a securing element attached or coupled to the leg rest portion and a corresponding securing element attached or coupled to the leg rest strap.

Accordingly, the presently disclosed invention provides a wheelchair leg guard that maintains a rider's feet and legs in a more secure position so that the rider's feet and legs cannot be caught under the wheelchair.

The presently disclosed invention separately provides a wheelchair leg guard that is easily retrofitted to an existing wheelchair.

The presently disclosed invention separately provides a wheelchair leg guard that easily accommodates various sized wheelchairs.

The presently disclosed invention separately provides a wheelchair leg guard that can be easily installed on a wheelchair.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein.

Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

For simplicity and clarification, the design factors and operating principles of the wheelchair leg guard according to this invention are explained with reference to various exemplary embodiments of a wheelchair leg guard according to this invention. The basic explanation of the design factors and operating principles of the wheelchair leg guard is applicable for the understanding, design, and operation of the wheelchair leg guard of this invention. It should be appreciated that the wheelchair leg guard can be adapted to many applications where a person's legs and/or feet cannot slip from a foot rest.

It should also be appreciated that the terms "wheelchair", "leg guard", "guard", and "wheelchair leg guard" are used for basic explanation and understanding of the operation of the systems, methods, and apparatuses of this invention. Therefore, the terms "wheelchair", "leg guard", "guard", and "wheelchair leg guard" are not to be construed as limiting the systems, methods, and apparatuses of this invention. For example, the term "wheelchair" is to be understood to broadly include any structures or devices capable of supporting a person and having spaced apart foot rests.

For simplicity and clarification, the wheelchair leg guard of this invention will be described as being used in conjunction with a certain type of wheelchair. However, it should be appreciated that these are merely exemplary embodiments of the wheelchair leg guard and are not to be construed as limiting this invention. Thus, the wheelchair leg guard of this invention may be utilized with various sizes, shapes, and types of wheelchairs.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 1:
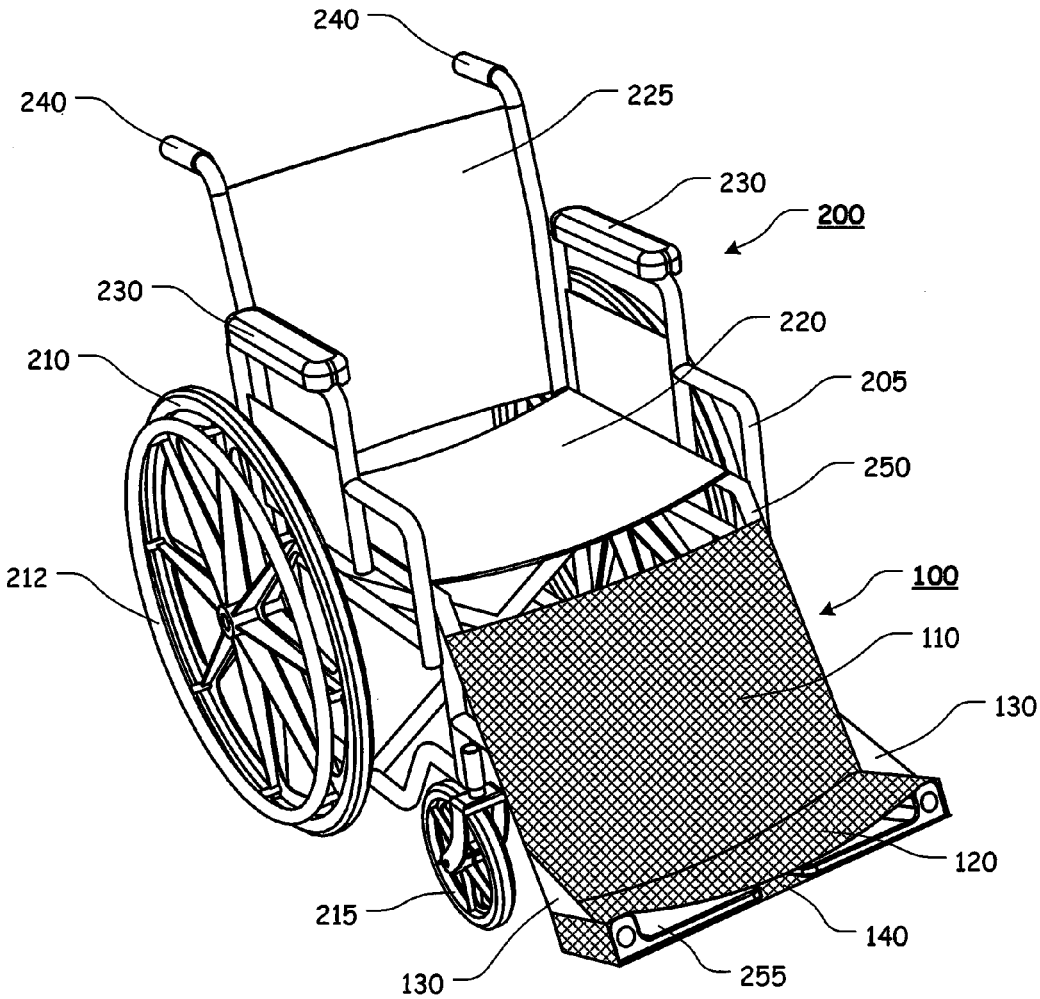
FIG. 1 illustrates a front perspective view of a wheelchair including an exemplary embodiment of a wheelchair leg guard, according to this invention.
Figure 2:
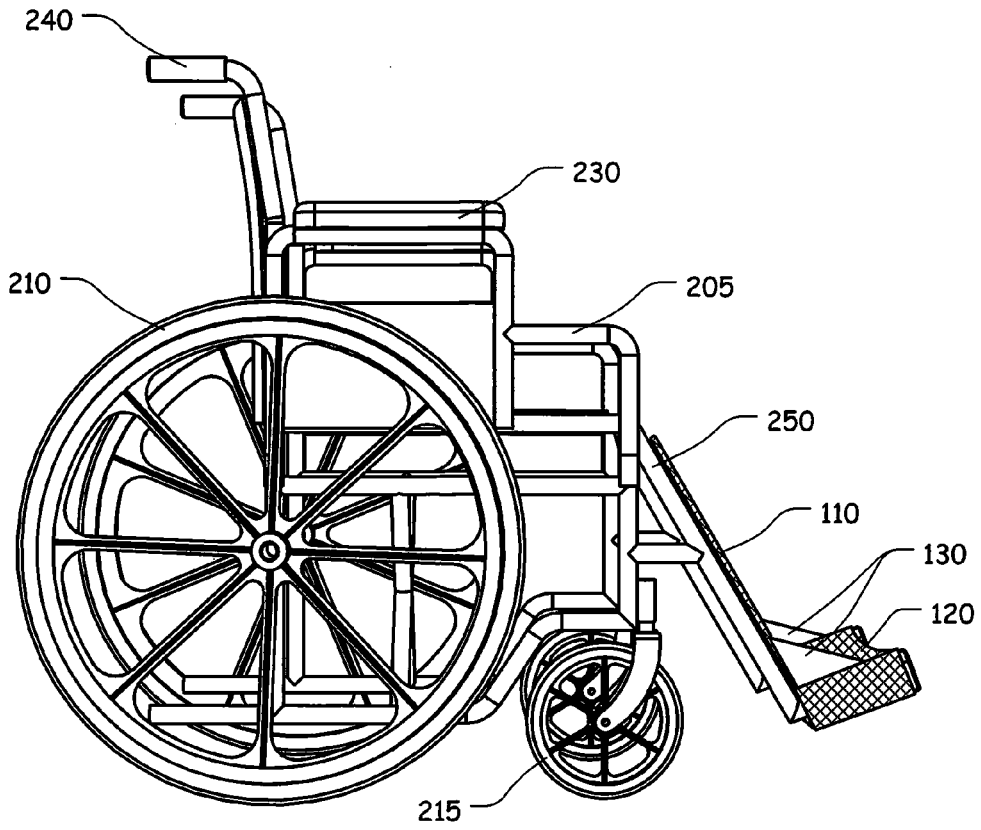
FIG. 2 illustrates a side view of a wheelchair including an exemplary embodiment of a wheelchair leg guard, according to this invention.
Figure 3:
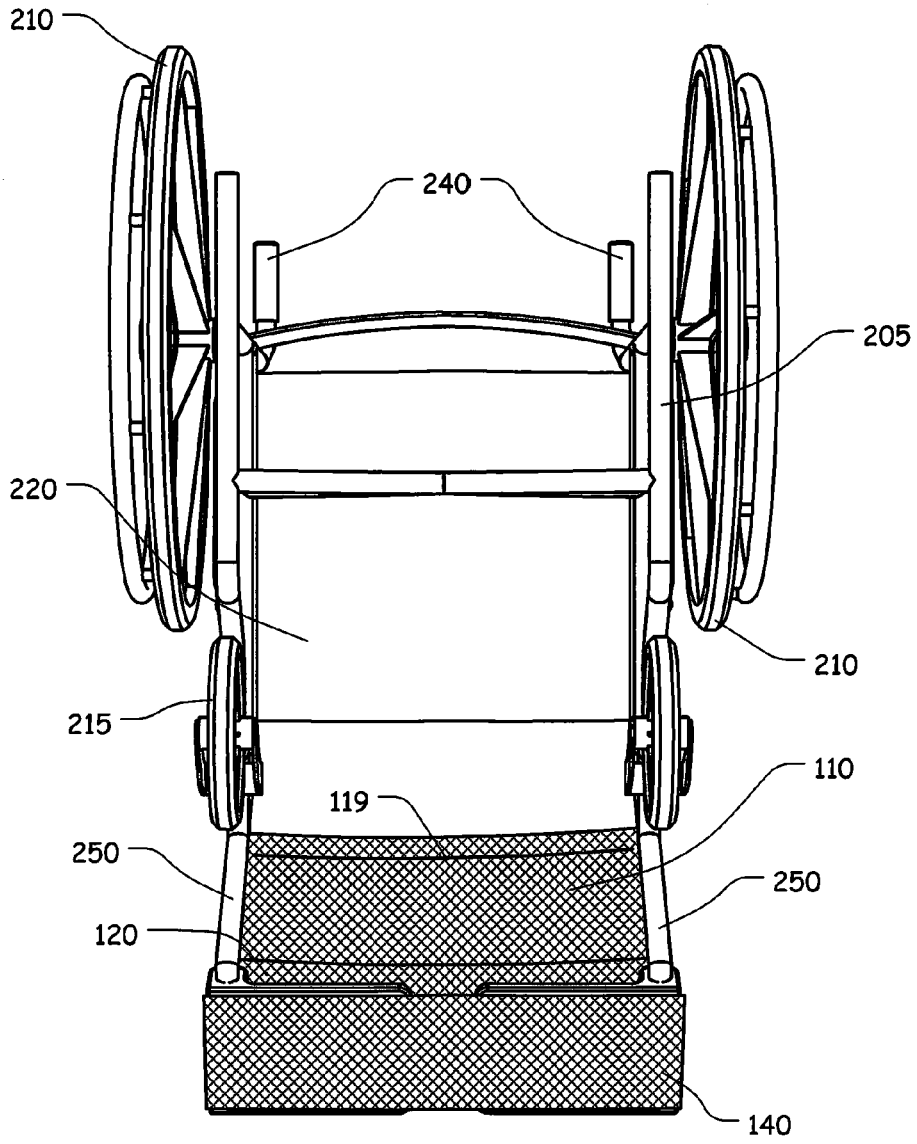
FIG. 3 illustrates a bottom view of a wheelchair including an exemplary embodiment of a wheelchair leg guard, according to this invention.
Figure 4:
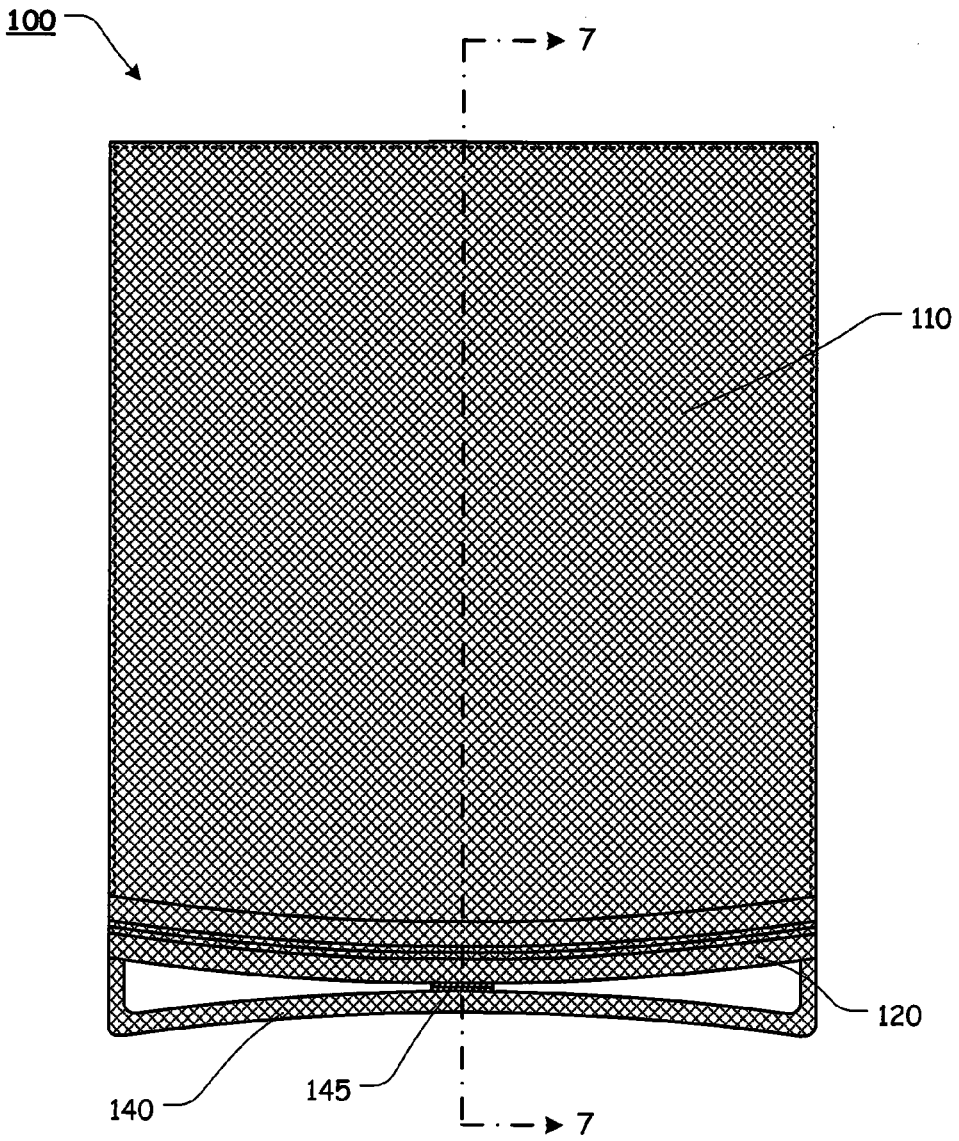
FIG. 4 illustrates a front view of an exemplary embodiment of a wheelchair leg guard, according to this invention.
Figure 5:
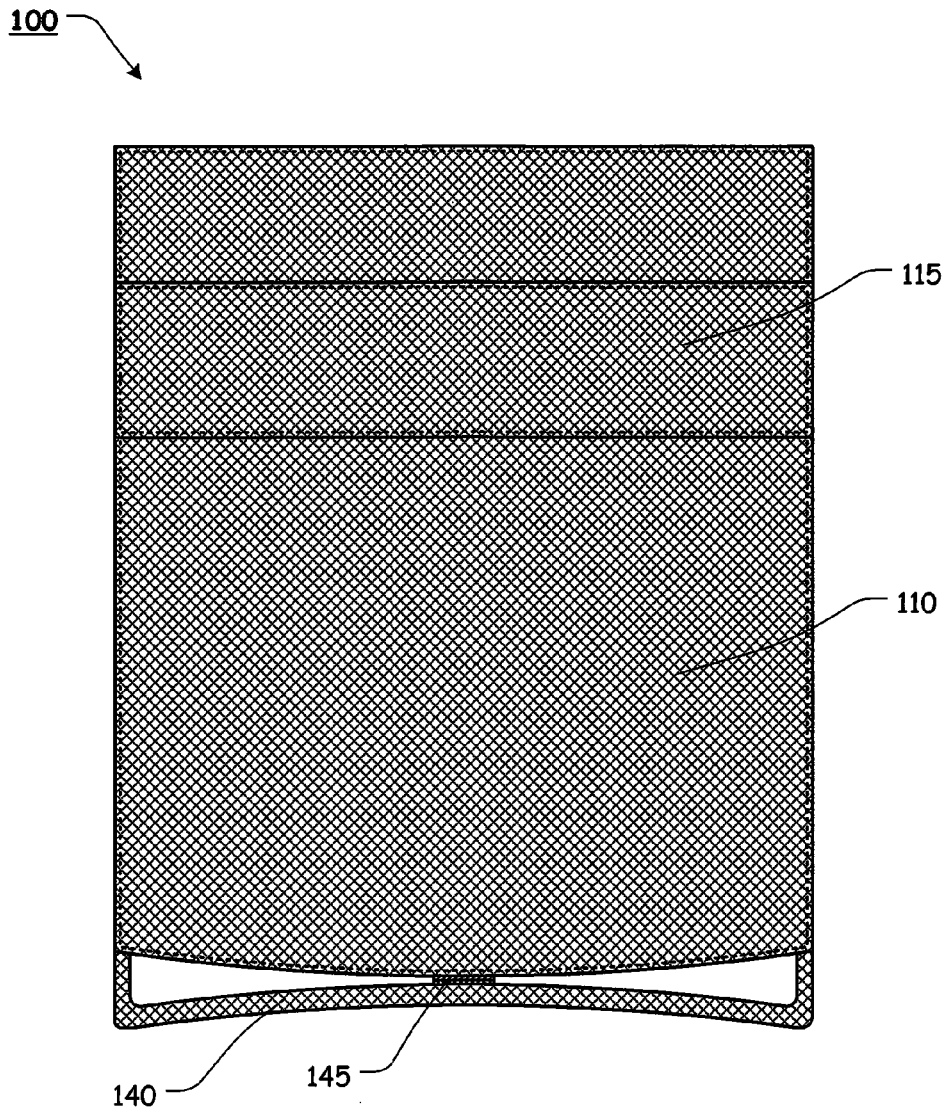
FIG. 5 illustrates a rear view of an exemplary embodiment of a wheelchair leg guard, according to this invention.
Figure 6:
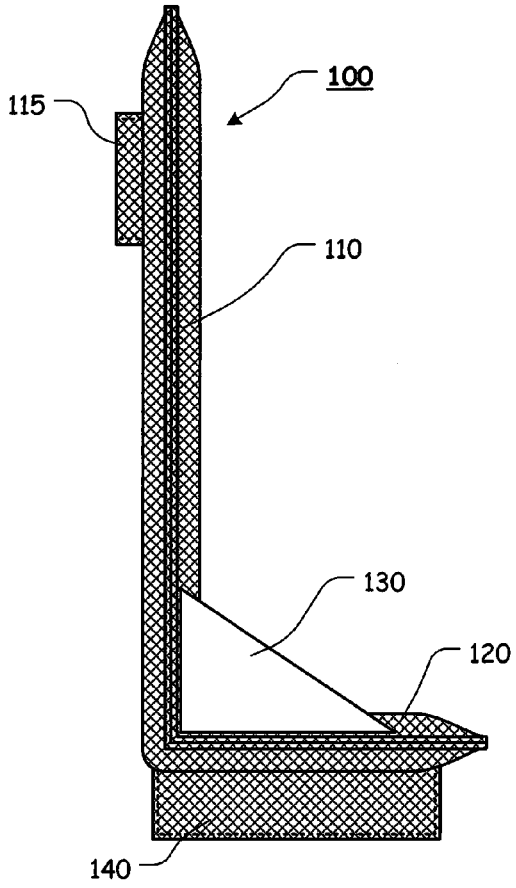
FIG. 6 illustrates a side view of an exemplary embodiment of a wheelchair leg guard, according to this invention.
Figure 7:
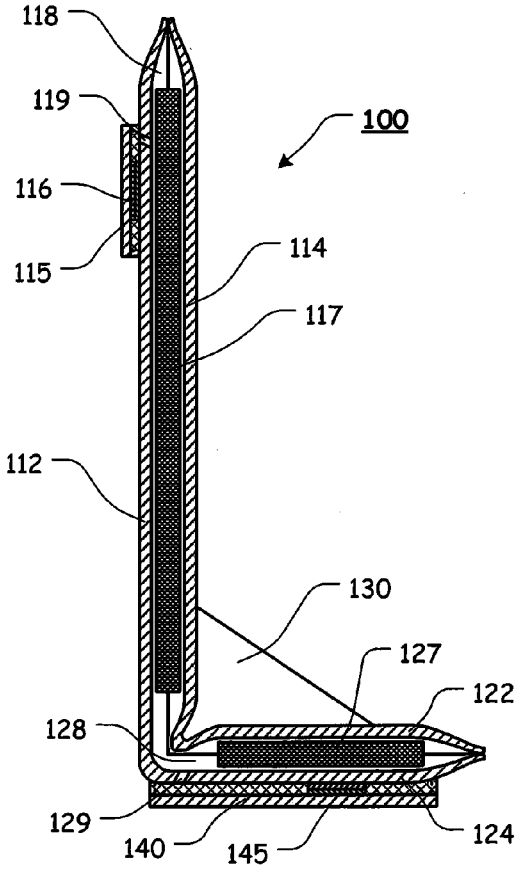
FIG. 7 illustrates a cross-sectional view, taken along line 7-7 of FIG. 4, showing certain aspects of an exemplary embodiment of a wheelchair leg guard, according to this invention.

Turning now to the drawing FIGS., FIGS. 1-3 illustrate certain elements and/or aspects of an exemplary embodiment of the wheelchair leg guard 100 secured to an exemplary wheelchair 200, while FIGS. 4-7 show certain features and/or elements of the wheelchair leg guard 100, according to this invention. In illustrative, non-limiting embodiment(s) of this invention, as illustrated in FIGS. 1-3, the wheelchair 200 comprises at least some of a frame 205, wheels 210 each having an associated push ring 212, castors 215, a seat 220, a backrest 225, armrests 230, handles 240, foot rest brackets 250, and footplates 255.

It should also be appreciated that a more detailed explanation of the standard wheelchair 200 is not provided herein because various wheelchairs are commercially available and/or such background information will be known to the one of ordinary skill in the art. Therefore, it is believed that the level of description provided herein is sufficient to enable one of ordinary skill in the art to understand, implement, and use the wheelchair leg guard of the present invention.

As illustrated in FIGS. 1-7, the wheelchair leg guard 100 comprises at least some of a leg rest portion 110, a back panel portion 112, a front panel portion 114, a leg rest strap 115, a securing element 116, a leg rest stabilizer 117, a leg rest cavity 118, a leg rest cavity access slot 119, a foot rest portion 120, a top panel portion 122, a bottom panel portion 124, a foot rest stabilizer 127, a foot rest cavity 128, a foot rest cavity access slot 129, a side guard 130, a foot rest strap 140, and a securing element 145.

In certain exemplary embodiments, the leg rest portion 110 comprises a front panel portion 114 and a back panel portion 112. Generally, the front panel portion 114 faces outward and would come into contact with portions of a rider's legs, when the rider is seated in the wheelchair 200 having a wheelchair leg guard 100. In contrast, the back panel portion 112 faces inward, away from a rider's legs.

A leg rest cavity 118 is defined between portions of the front panel portion 114 and the back panel portion 112. The overall size and shape of the leg rest cavity 118 is a design choice. However, in certain exemplary embodiments, the leg rest cavity 118 is sized so as to allow a leg rest stabilizer 117 to be disposed within the leg rest cavity 118. If a leg rest stabilizer 117 is included, the leg rest stabilizer 117 can provide additional support to the leg rest portion 110 and help to stabilize a rider's legs.

A leg rest cavity access slot 119 may be formed through at least a portion of the back panel portion 112 so as to provide access to the leg rest cavity 118. In this manner, the leg rest stabilizer 117 may be placed within the leg rest cavity 118 or removed from the leg rest cavity 118, as desired.

The foot rest portion 120 extends from the leg rest portion 110. In certain exemplary embodiments, the foot rest portion 120 includes a top panel portion 122 and a bottom panel portion 124. Generally, the top panel portion 122 faces upward and would come into contact with portions of a rider's feet, when the rider is seated in the wheelchair 200 having a wheelchair leg guard 100. In contrast, the bottom panel portion 124 faces downward, away from the rider's feet.

A foot rest cavity 128 is defined between the top panel portion 122 and the bottom panel portion 124. The overall size and shape of the foot rest cavity 128 is a design choice. However, in certain exemplary embodiments, the foot rest cavity 128 is sized so as to allow a foot rest stabilizer 127 to be disposed within the foot rest cavity 128. If a foot rest stabilizer 127 is included, the foot rest stabilizer 127 can provide additional support to the foot rest portion 120 and additional support to a rider's feet.

A foot rest cavity access slot 129 may be formed through at least a portion of the bottom panel portion 124 so as to provide access to the foot rest cavity 128. In this manner, the foot rest stabilizer 127 may be placed within the foot rest cavity 128 or removed from the foot rest cavity 128, as desired.

In certain exemplary embodiments, the leg rest portion 110 and the foot rest portion 120 are continuous portions of material that are formed as an integral unit. Alternatively, the leg rest portion 110 and the foot rest portion 120 may be formed of separate sections or elements made independently and attached or coupled together, such as by adhesives, welding, screws, rivets, pins, or other fasteners.

The foot rest strap 140 is formed of an elongate portion of material and extends from a first end to a second end. The first end of the foot rest strap 140 is attached or coupled to the foot rest portion 120 proximate a first end of the foot rest portion 120. Similarly, the second end of the foot rest strap 140 is attached or coupled to the foot rest portion 120 proximate a second end of the foot rest portion 120. The foot rest strap 140 is formed so as to be positioned around and below at least a portion of the footplates 255 to help secure the foot rest portion 122 to the wheelchair 200.

In certain embodiments, the foot rest strap 140 is formed of a substantially flexible or elastic material. In certain alternative embodiments, the foot rest strap 140 is formed of a substantially rigid material.

To aid in securing the foot rest portion 120 to the wheelchair 200, when the wheelchair leg guard 100 is installed on a wheelchair 200, a portion of the foot rest strap 140 is releasably secured to a portion of the foot rest portion 120 via interaction of a length of securing element 145 attached or coupled to the foot rest portion 120 and a length of corresponding securing element 145 attached or coupled to the foot rest strap 140.

The securing element 145 may be attached or coupled to the foot rest portion 120 proximate a central portion of the foot rest portion 120. Likewise, the corresponding securing element 145 is attached or coupled to the foot rest strap 140 proximate a central portion of the foot rest strap 140. Alternatively, the securing element 145 may be attached or coupled to the foot rest portion 120 proximate the first or second end of the foot rest portion 120. Likewise, the corresponding securing element 145 is attached or coupled to the foot rest strap 140 proximate the first or second end of the foot rest strap 140.

In various exemplary embodiments, the securing element 145 comprises corresponding portions of VELCRO® or other hook-and-loop fastener material, a male/female snap-release buckle, modular buckle, button, rivet, snap, snap-hook, or other known or later developed releasable fastener, closure, or securing means, which is capable of releasably connecting or coupling the foot rest portion 120 to the foot rest strap 140.

In order to provide structural support and stability to the leg rest portion 110 and the foot rest portion 120, the side guards 130 extend between and are attached or coupled to both the foot rest portion 120 and the leg rest portion 110. In certain exemplary embodiments, the side guards 130 are triangular-shaped portions of material having a first side attached or coupled to the foot rest portion 120 and a second side attached or coupled to the leg rest portion 110.

In still other exemplary embodiments, the side guards 130 are rectangular-shaped portions of material having a first end attached or coupled to the foot rest portion 120 and a second end attached or coupled to the leg rest portion 110.

In certain embodiments, the side guards 130 are formed of a substantially flexible or elastic material. In certain alternative embodiments, the side guards 130 are formed of a substantially rigid material.

In various embodiments, the wheelchair leg guard 100 further comprising a leg rest strap 115. The leg rest strap 115 is formed of an elongate portion of material and extends from a first end to a second end. The first end of the leg rest strap 115 is attached or coupled to the leg rest portion 110 proximate a first end of the leg rest portion 110. Similarly, the second end of the leg rest strap 115 is attached or coupled to the leg rest portion 110 proximate a second end of the leg rest portion 110. The leg rest strap 115 is formed so as to be positioned around at least a portion of the foot rest bracket 250 to help secure the leg rest portion 110 the wheelchair 200.

In certain embodiments, the leg rest strap 115 is formed of a substantially flexible or elastic material. In certain alternative embodiments, the leg rest strap 115 is formed of a substantially rigid material.

To aid in securing the leg rest portion 110 to the wheelchair 200, when the wheelchair leg guard 100 is installed on a wheelchair 200, a portion of the leg rest strap 115 is releasably secured to a portion of the leg rest portion 110 via interaction of a length of securing element 116 attached or coupled to the leg rest portion 110 and a length of corresponding securing element 116 attached or coupled to the leg rest strap 115.

The securing element 116 may be attached or coupled to the leg rest portion 110 proximate a central portion of the leg rest portion 110. Likewise, the corresponding securing element 116 is attached or coupled to the leg rest strap 115 proximate a central portion of the leg rest strap 115. Alternatively, the securing element 116 may be attached or coupled to the leg rest portion 110 proximate the first or second end of the leg rest portion 110. Likewise, the corresponding securing element 116 is attached or coupled to the leg rest strap 115 proximate the first or second end of the leg rest strap 115.

In various exemplary embodiments, the securing element 116 comprises corresponding portions of VELCRO® or other hook-and-loop fastener material, a male/female snap-release buckle, modular buckle, button, rivet, snap, snap-hook, or other known or later developed releasable fastener, closure, or securing means, which is capable of releasably connecting or coupling the leg rest portion 110 to the leg rest strap 115.

In various exemplary, non-limiting embodiments, the leg rest portion 110 and/or the foot rest portion 120 may be made of expandable weave cotton or waffle weave material. Alternatively, the leg rest portion 110 and/or the foot rest portion 120 may be made of any fabric or other material, such as, for example, woven fabrics, canvas, acrylics, sheet fabrics, films, nylon, spandex, vinyl, Polyvinyl Chloride (PVC), neoprene, or the like. Additionally, the leg rest portion 110 and/or the foot rest portion 120 may be made of any flexible and/or elastic material and may stretch. Alternatively, the leg rest portion 110 and/or the foot rest portion 120 may be formed from multiple, similar or dissimilar materials. In various exemplary, non-limiting embodiments, the leg rest portion 110 and/or the foot rest portion 120 may be water-resistant or may include a cushioning material.

It should be appreciated that the terms fabric and material are to be given their broadest meanings and that the particular fabric(s) or material(s) used to form the leg rest portion 110 and/or the foot rest portion 120 is a design choice based on the desired appearance and/or functionality of the wheelchair leg guard 100.

It should also be appreciated that certain elements of the wheelchair leg guard 100 may be formed as an integral unit (such as, for example, the leg rest portion 110 and the foot rest portion 120). Alternatively, suitable materials can be used and sections or elements made independently and attached or coupled together, such as by adhesives, welding, screws, rivets, pins, or other fasteners, to form the various elements of the wheelchair leg guard 100.

It should be understood that the overall size and shape of the wheelchair leg guard 100, and the various portions thereof, is a design choice based upon the desired functionality and/or appearance of the wheelchair leg guard 100.

To install and use the wheelchair leg guard 100, the foot rest portion 120 is placed atop the foot plates 255 of the wheelchair 200 and the foot rest strap 140 is positioned below the foot plates 255. In certain instances, the foot plates 255 are slid into the cavity formed between the foot rest portion 120 and the foot rest strap 140. When the foot rest portion 120 is correctly positioned, the corresponding portions of the securing element 145 are attached or coupled together to further secure the foot rest portion 122 the wheelchair 200.

The leg rest portion 110 is then positioned to rest against the foot rest brackets 250. In certain exemplary embodiments, the leg rest strap 115 (if included) is positioned around the foot rest brackets 250 so as to secure the leg rest portion 110 to the wheelchair 200. When the leg rest portion 110 is correctly positioned, the corresponding portions of the securing element 117 are attached or coupled together to further secure the leg rest portion 110 the wheelchair 200.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

In addition, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A wheelchair leg guard, comprising:

a leg rest portion, wherein said leg rest portion comprises a front panel portion and a back panel portion, wherein a leg rest cavity is defined between said front panel portion and said back panel portion, and wherein a leg rest stabilizer is disposed within said leg rest cavity;

a foot rest portion, wherein said foot rest portion extends from said leg rest portion, wherein said foot rest portion comprises a top panel portion and a bottom panel portion, wherein a foot rest cavity is defined between said top panel portion and said bottom panel portion, and wherein a foot rest stabilizer is disposed within said foot rest cavity;

a foot rest strap, wherein said foot rest strap extends from a first end to a second end, wherein said first end is attached or coupled to said foot rest portion proximate a first end of said foot rest portion and said second end is attached or coupled to said foot rest portion proximate a second end of said foot rest portion, and wherein a portion of said foot rest strap is releasably secured to a portion of said foot rest portion via interaction of a securing element attached or coupled to said foot rest portion and a corresponding securing element attached or coupled to said foot rest strap; and side guards, wherein each side guard extends between and is attached or coupled to both said foot rest portion and said leg rest portion.

2. The wheelchair leg guard of claim 1, wherein said leg rest portion comprises a substantially rigid material.

3. The wheelchair leg guard of claim 1, wherein said leg rest portion comprises a substantially flexible or elastic material.

4. The wheelchair leg guard of claim 1, wherein said foot rest portion comprises a substantially rigid material.

5. The wheelchair leg guard of claim 1, wherein said foot rest portion comprises a substantially flexible or elastic material.

6. The wheelchair leg guard of claim 1, wherein said leg rest portion and said foot rest portion each comprise separate portions that are attached or coupled together.

7. The wheelchair leg guard of claim 1, wherein said leg rest portion and said foot rest portion are portions of a continuous portion of material.

8. The wheelchair leg guard of claim 1, wherein said securing element is attached or coupled to said foot rest portion proximate a central portion of said foot rest portion and said corresponding securing element is attached or coupled to said foot rest strap proximate a central portion of said foot rest strap.

9. The wheelchair leg guard of claim 1, wherein each side guard comprises a substantially rigid material.

10. The wheelchair leg guard of claim 1, wherein each side guard comprises a substantially flexible or elastic material.

11. The wheelchair leg guard of claim 1, wherein said securing element comprises a portion of hook-and-loop fastener material, a male/female snap-release buckle, modular buckle, button, rivet, snap, snap-hook.

12. The wheelchair leg guard of claim 1, further comprising a leg rest strap, wherein said leg rest strap extends from a first end to a second end, wherein said first end is attached or coupled to said leg rest portion proximate a first end of said leg rest portion and said second end is attached or coupled to said leg rest portion proximate a second end of said leg rest portion, and wherein a portion of said leg rest strap is releasably secured to a portion of said leg rest portion via interaction of a securing element attached or coupled to said leg rest portion and a corresponding securing element attached or coupled to said leg rest strap.

13. The wheelchair leg guard of claim 1, further comprising a leg rest cavity access slot formed through at least a portion of said back panel portion, wherein said leg rest cavity access slot provides access to said leg rest cavity.

14. The wheelchair leg guard of claim 1, further comprising a foot rest cavity access slot formed through at least a portion of said bottom panel portion, wherein said foot rest cavity access slot provides access to said foot rest cavity.

15. A wheelchair leg guard, comprising:

a leg rest portion, wherein a leg rest cavity is defined between a front panel portion and a back panel portion of said leg rest portion, and wherein a leg rest stabilizer is disposed within said leg rest cavity;

a foot rest portion, wherein said foot rest portion extends from said leg rest portion, wherein a foot rest cavity is defined between a top panel portion and a bottom panel portion of said foot rest portion, and wherein a foot rest stabilizer is disposed within said foot rest cavity;

a foot rest strap, wherein said foot rest strap extends from a first end to a second end, wherein said first end is attached or coupled to said foot rest portion proximate a first end of said foot rest portion and said second end is attached or coupled to said foot rest portion proximate a second end of said foot rest portion, and wherein a portion of said foot rest strap is releasably secured to a portion of said foot rest portion via interaction of a securing element attached or coupled to said foot rest portion and a corresponding securing element attached or coupled to said foot rest strap; and side guards, wherein each side guard extends between and is attached or coupled to both said foot rest portion and said leg rest portion.

16. The wheelchair leg guard of claim 15, wherein said securing element is attached or coupled to said foot rest portion proximate a central portion of said foot rest portion and said corresponding securing element is attached or coupled to said foot rest strap proximate a central portion of said foot rest strap.

17. The wheelchair leg guard of claim 15, further comprising a leg rest strap, wherein said leg rest strap extends from a first end to a second end, wherein said first end is attached or coupled to said leg rest portion proximate a first end of said leg rest portion and said second end is attached or coupled to said leg rest portion proximate a second end of said leg rest portion, and wherein a portion of said leg rest strap is releasably secured to a portion of said leg rest portion via interaction of a securing element attached or coupled to said leg rest portion and a corresponding securing element attached or coupled to said leg rest strap.

18. A wheelchair leg guard, comprising:

a leg rest portion;

a foot rest portion, wherein said foot rest portion extends from said leg rest portion;

a foot rest strap, wherein said foot rest strap extends from a first end to a second end, wherein said first end is attached or coupled to said foot rest portion proximate a first end of said foot rest portion and said second end is attached or coupled to said foot rest portion proximate a second end of said foot rest portion, and wherein a portion of said foot rest strap is releasably secured to a portion of said foot rest portion via interaction of a securing element attached or coupled to said foot rest portion and a corresponding securing element attached or coupled to said foot rest strap; and side guards, wherein each side guard extends between and is attached or coupled to both said foot rest portion and said leg rest portion.

19. The wheelchair leg guard of claim 18, wherein said securing element is attached or coupled to said foot rest portion proximate a central portion of said foot rest portion and said corresponding securing element is attached or coupled to said foot rest strap proximate a central portion of said foot rest strap.

20. The wheelchair leg guard of claim 18, further comprising a leg rest strap, wherein said leg rest strap extends from a first end to a second end, wherein said first end is attached or coupled to said leg rest portion proximate a first end of said leg rest portion and said second end is attached or coupled to said leg rest portion proximate a second end of said leg rest portion, and wherein a portion of said leg rest strap is releasably secured to a portion of said leg rest portion via interaction of a securing element attached or coupled to said leg rest portion and a corresponding securing element attached or coupled to said leg rest strap.

* * * * *